United States Patent [19]

Bucksbee et al.

[11] Patent Number: 4,715,533

[45] Date of Patent: Dec. 29, 1987

[54] RAIL FASTENER ASSEMBLY WITH HORIZONTAL FLANGES

[76] Inventors: James H. Bucksbee, 5187 West Rd., McKean, Pa. 16426; Casimir K. Siwek, 3427 Aberdeen Ave., Erie, Pa. 16506

[21] Appl. No.: 846,790

[22] Filed: Apr. 1, 1986

[51] Int. Cl.[4] ..... E01B 9/62; E01B 9/68

[52] U.S. Cl. ..... 238/283; 238/264; 238/287; 248/634

[58] Field of Search ..... 238/283, 310, 264, 282, 238/302, 297, 269, 292, 349, 287; 248/632, 634; 220/72; 206/557

[56] References Cited

U.S. PATENT DOCUMENTS

| | | | |
|---|---|---|---|
| 2,656,066 | 10/1953 | Riemenschneider | 220/72 X |
| 3,576,293 | 4/1971 | Landis et al. | 238/287 |
| 3,784,097 | 1/1974 | Landis | 238/310 |
| 3,858,804 | 1/1975 | Hixson | 238/310 X |
| 3,957,127 | 5/1976 | Bouchard et al. | 248/634 X |
| 4,527,736 | 7/1985 | Ortwein | 238/283 |

FOREIGN PATENT DOCUMENTS 1204697 11/1965 Fed. Rep. of Germany .

*Primary Examiner*—Robert B. Reeves
*Assistant Examiner*—Scott H. Werny

[57] ABSTRACT

An upper rail supporting plate is interconnected by resilient material to a lower foundation plate for lateral and vertical movement. Lateral movement of the upper plate transverse to the rail direction is limited by reinforced upstanding flanges upon a first pair of edges of the lower plate. The reinforcement includes horizontal flanges projecting outwardly from the upper edges of the upstanding flanges. Additional flanges upon a second pair of lower plate edges contribute further reinforcement, and limit upper plate movement in the rail direction. Toothed washers mount the lower plate for lateral adjustive movement in preselected increments of differing magnitudes.

10 Claims, 6 Drawing Figures

RAIL FASTENER ASSEMBLY WITH HORIZONTAL FLANGES

This invention relates to rail fastener assemblies that mount railway rails for resilient vertical and lateral movement relative to underlying concrete or wood ties or similar support structures. The invention more specifically relates to an improved rail fastener of the type having an upper rail-supporting plate resiliently connected to a lower foundation plate by a body of elastomeric material that reacts vertical and lateral loads upon the rail primarily by compression and shear, respectively.

BACKGROUND OF THE INVENTION

Rail fasteners of the general type described above have heretofore been proposed: see e.g., German Auselgeschrift No. 1204697 and U.S. Pat. No. 3,576,293. The assemblies of each of the foregoing references include vertically extending flanges provided adjacent the opposite lateral edges of the lower plate for the purpose of limiting the extent of lateral movement of the rail-supporting upper plate of the assembly. Rail fastener assemblies of the aforesaid construction have not heretofore enjoyed widespread commercial acceptance. If the compression stiffness of the assemblies is sufficiently low as to provide the desired attenuation of the vertical shock and vibrations forces, the fastener assemblies do not perform satisfactorily under lateral or combined lateral and vertical loading. As is noted in U.S. Pat. No. 3,784,097, issued to the same assignee as above-discussed U.S. Pat. No. 3,576,293, lateral loading results in excessive deflection of the rail-supporting upper plate. Additionally, the magnitude of the lateral forces then imposed upon the upstanding flange of the bottom plate of the assembly can result in structural failure of such flange.

SUMMARY OF THE INVENTION

With the foregoing in mind, the present invention provides an improved rail fastener assembly of the type in which lateral movement of a rail-supporting upper plate is restrained by peripheral flange means upon a lower plate of the assembly that is interconnected to the upper plate by resilient elastomeric material. The assembly of the present invention may and normally does have low vertical and horizontal spring rates providing good attenuation and damping of vertical and horizontal shocks and vibrations. At the same time the fastener assembly is of a durable construction capable of sustaining large magnitude lateral loads without flange failure. More specifically in the foregoing regard, reinforcing or strengthing means are provided in association with the vertical flanges upon the pair of lower plate opposite peripheral edges that extend generally parallel to the longitudinal axis of the supported rail. The aforesaid reinforcing means includes an additional flange formed integral with and projecting outwardly from the upper edge of each vertical flange. In a preferred embodiment of the invention, the reinforcing means further includes additional flange means formed integral with that upon the aforesaid first pair of lower plate edges, such additional flange means being disposed upon the other plate edges that are generally perpendicular to the rail. The flange means upon the second-mentioned plate edges preferably are of the same type along part of their length as the flange means upon the first plate-mentioned plate edges. However, the flange means upon the second edges do not extend along the entire extent thereof, and along part of their length preferably consist only of a sloping vertical flange.

In one embodiment thereof, the assembly includes adjustable means mounting the lower plate for lateral adjusted movement, in increments of selectable variable magnitude, relative to the underlying tie or other support structure.

DESCRIPTION OF THE DRAWINGS

Other features of the invention will be apparent from the following description of illustrative embodiments thereof, which should be read in conjunction with the accompanying drawings, in which.

DESCRIPTION OF THE PREFERRED EMBODIMENTS

Figures 1, 2, 3:
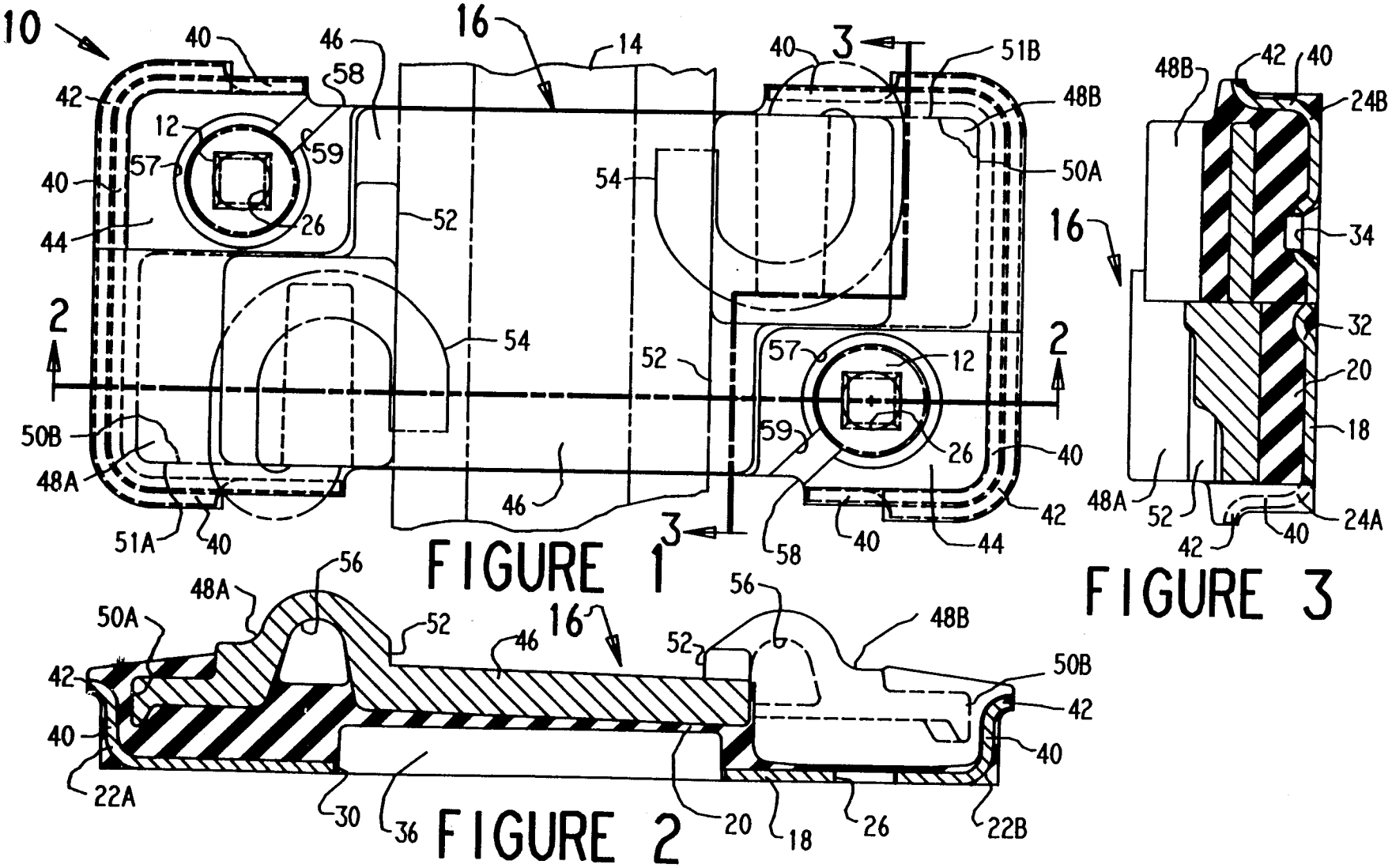
FIG. 1 is a top plan view of a rail fastener assembly in accordance with the invention, there also being shown by phantom lines fragmentary portion of a railroad rail, rail engaging clip elements, and assembly anchor bolts.
FIG. 2 is a vertical section taken approximately along the line 2—2 of FIG. 1.
FIG. 3 is a vertical section taken approximately along the staggered line 3—3 of FIG. 1.
Figure 5:
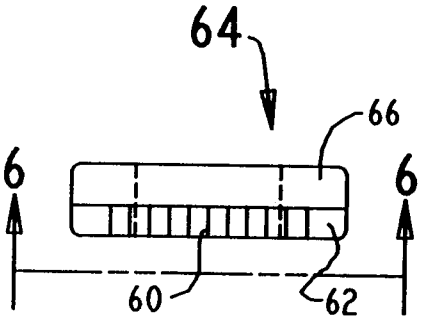
FIGS. 5 and 6 are enlarged side elevational and bottom plan views, respectively, of a toothed washer useable in association with the bottom plate having anchor bolt receiving openings of the toothed construction shown in FIG. 4.

The fastener assembly designated in its entirety in FIGS. 1-3 of the drawings is adapted to be fixedly secured to an underlying tie or other support structure (not shown), as by means of suitable anchor bolts 12 (FIG. 1), and to mount a rail 14 for resilient vertical and lateral movement relative to the underlying support structure. Assembly 10 includes upper and lower plates 16, 18 interconnected by resilient elastomeric material 20 bonded thereto.

Figure 4:
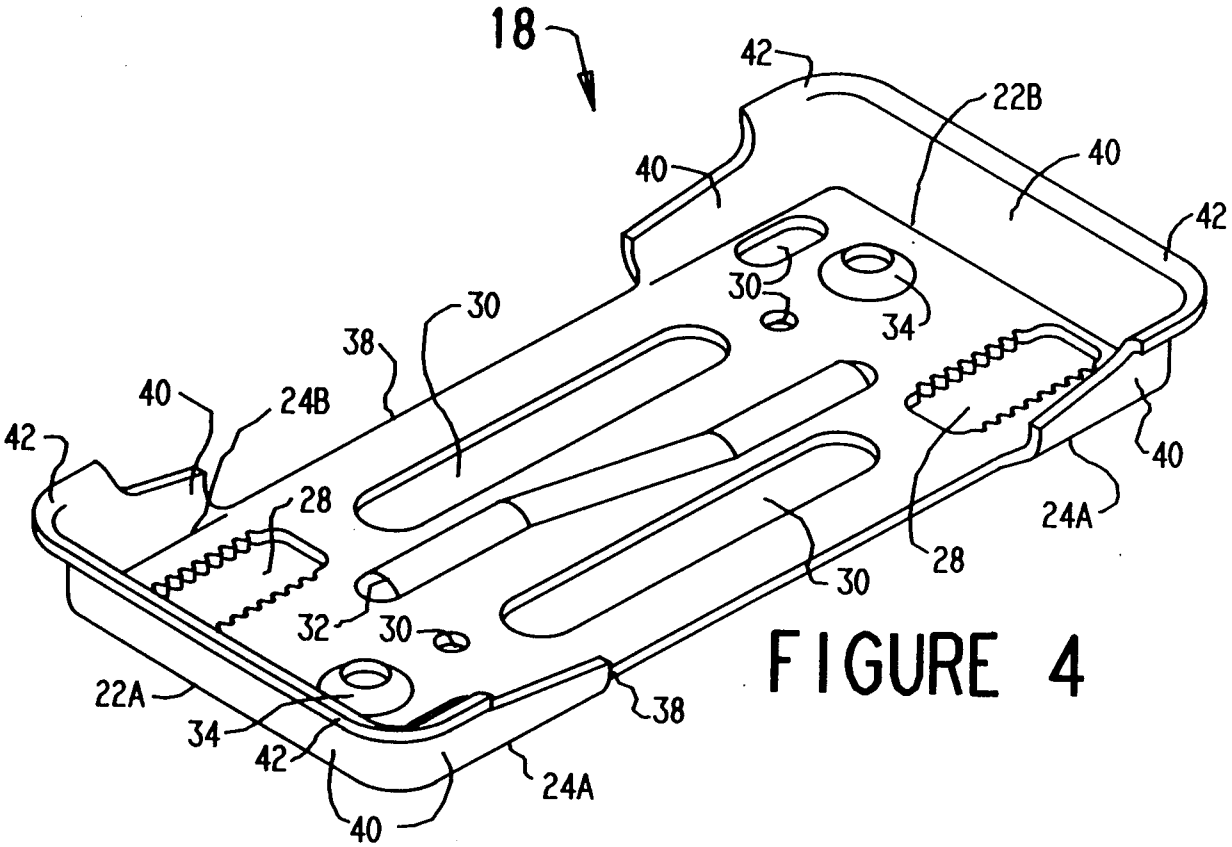
FIG. 4 is a perspective view of the lower plate of the assembly, showing an alternative toothed construction of the openings through which extend the assembly anchor bolts.

Referring now also to FIG. 4 of the drawings, lower plate 18 of the assembly 10 is of generally rectangular shape, having a first pair of opposite peripheral edges 22A, 22B that extend in the rail direction, i.e., generally parallel to the longitudinal axis of rail 14, and a second pair of peripheral edges 24A, 24B extending generally perpendicularly to the rail direction and to the first pair of edges. At diagonally opposite corner areas thereof, plate 18 is provided with vertical openings for reception of the anchor bolts 12 by which the plate is secured to the underlying tie or other support structure (not shown). If a capability for lateral adjustment of the position of plate 18 is not required or desired, the aforesaid openings may be simple circular bores 26 as shown in FIGS. 1 and 2. When an adjustment capability. is desired, the generally rectangular toothed openings 28 shown in FIG. 4 are provided. The main body of plate 18 may be and illustratively is further provided with a number of additional openings 30, an elongate stiffening rib 32, and with a pair of upwardly projecting dimple-like sections 34 located adjacent respective ones of the plate edges 22A and 22B. Openings 30 are provided to facilitate the formation during manufacture of assembly 10 of overlying "shape-factor" openings or recesses, such as that designated by the numeral 36 in FIG. 2, within elastomeric material 20. As is well known to those skilled in the art, the provision of such openings within the elastomer material reduces the compression stiffness of assembly 10 by increasing the elastomer area that is free to bulge when the assembly is subjecteed to vertical compression loading. Projections 34 limit the vertical extent of relative movement between plates 16, 18 when plate 18 is subjected to vertical, or combined vertical and lateral, loads. Centrally of its second pair of edges 24, plate 18 is also provided with peripheral recesses 38 that facilitate manufacture.

Flange means is provided in association with edges 22 and part of edges 24 of plate 18. In the expanses thereof along edges 22 and the immediately adjacent end sections of edges 24, the aforesaid flange means comprises an upstanding flange 40 formed integrally with and extending generally vertically upwardly from the periphery of the main body portion of plate 18, and a flange 42 formed integrally with and extending generally horizontally outwardly from the upper end of flange 40. The generally vertically extending flanges 40 upon plate edges 22 are subjected, during use of assembly 10, to outwardly directed lateral forces of very large magnitude. These forces tend to produce failure of such flanges, particularly in the more highly stressed upper portions thereof. The flanges 42 integral with the upper portions of flanges 40 upon plate edges 22 constitute reinforcing means that greatly strengthens flanges 40 and thus enhances the ability thereof to withstand, without failure, the aforesaid lateral forces imposed thereon. Additional reinforcement and strengthening of the flanges 40 upoh plate edges 22 is provided by the flange means integral with their opposite ends and with the immediately adjacent sections of plate edges 24. The flange means upon each edge 24 of plate 18 terminates at the central recess 38 within the edge. The section of the flange means immediately adjacent each corner of the plate is of the same construction as the flange means upon plate edges 22, consisting of a vertically extending flange 40 and an outwardly extending flange 42 at the upper end thereof. Along the remainder of its length, the flange means upon each plate edge 24 lacks the outwardly extending flange 42 and consists of a tapered vertical flange 40 that slopes downwardly to plate recess 38.

As is best shown in FIG. 1, upper plate 16 of fastener 10 is of generally rectangular shape but has peripheral openings at two of its diagonally opposite corner areas. The surfaces of such openings and of thereto adjacent parts of lower plate 18 define open-top enclosures 44 that shield anchor bolts 12, while permitting ready access to them when required. Each enclosure 44 has an outlet opening 58 extending to an associated one of the recesses 38 of lower plate 18. Each opening 58 extends in a vertical direction upwardly from lower plate 18, which preferably is overlaid within enclosures 44 by a thin coating of elastomer. Each opening 58 is sufficiently wide as to permit free passage from the associated enclosure 44 of any water and/or debris that might otherwise tend to accumulate therein during use of assembly 10. To further promote discharge from each enclosure 44, the therein provided elastomeric coating upon plate 18 slopes downwardly toward an annular area 57 and thence along the length of a channel shaped area 59 leading from area 57 to the enclosure opening 58.

A central section 46 of plate 16 is disposed between offset opposite side sections 48A, 48B having peripheral edges 50A, 50B and 51A, 51B. Edges 50 have downwardly extending flanges thereon, as shown in FIG. 2, and extend in generally parallel laterally spaced relationship to the vertical flanges 40 upon respective ones of lower plate edges 22A, 22B. Edges 51A, 51B extend generally parallel to thereto confronting sections of the flanges 40 upon respective ones of lower plate edges 24A, 24B. In addition to their previously described reinforcing function, the flanges 40 that confront upper plate edges 51A, 51B serve to limit movement of plate 16 in the rail direction. Rail 14 rests upon the upper surface of plate section 46, which plate section may be slightly inclined relative to the horizontal as shown in FIG. 2 and as is customary. The rail base is closely received between upstanding shoulders 52 upon plate side sections 48, and is releasably secured in place by suitable clamping means such as the illustrated Pandrol-type clips 54 that engage and overlie the rail base and have end portions received within suitable sockets 56 of plate sections 48.

Figure 6:
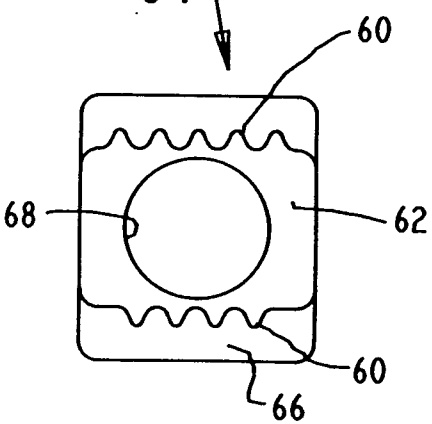

In certain utilizations of assembly 10 it may be necessary or desirable for the assembly to be capable of lateral adjustment relative to the underlying tie or other support structure (not shown). In that situation lower plate 18 is provided with the rectangular openings 28 shown in FIG. 4, in lieu of the circular bores 26 shown in FIGS. 1 and 2. Each opening 28 has toothed opposite edges that intermesh with toothed opposite edges 60 upon the lower portion 62 of a washer element 64 associated with each plate opening 28. Each washer element 64 further has an upper portion 66 that overlies upper surface portions of plate 18 when the washer portion 66 is received within the associated plate opening 28. A vertical bore 68 within each washer 64 is adapted to receive a suitable anchor bolt such as that designated in FIG. 1 by the numeral 12. As is best shown in FIG. 6, the teeth upon one edge 60 of washer 64 are staggered with respect to the teeth upon the opposite edge 60 of such washer, such that each tooth upon either edge is aligned with a "valley" upon the opposite edge. The teeth upon opposite edges of each plate opening 28 are similarly offset from each other. This allows lateral adjustment of the position of plate 18 relative to the underlying tie or other support structure (not shown) to be made in either full-pitch tooth increments or in half-pitch increments. If full-pitch incremental adjustment of the lateral position of plate 18 is desired, washers 64 are simply raised out of their respective plate openings 28 and then are reinserted without reorientation within such openings after lateral adjustive movement of plate 18 has been effected. If half-pitch adjustment is desired, each washer 18 is rotated 180° about its vertical central axis before being reinserted within its associated plate opening 28.

Vertical loads imposed upon assembly 10 during use thereof are reacted primarily by compression of the elastomer material 20 disposed between the undersurface of upper plate 16 and the upper surface of lower plate 18. Vertical loads are also partially reacted, but only to a much lesser extent, by shear of the elastomeric material 20 between upstanding flanges 40 of lower plate 18 and the confronting flanged edges 50 of upper plate 16. The lateral components of forces imposed during use upon assembly 10 are reacted by shear of the elastomer between the aforesaid major surfaces of plates 16, 18 and by compression of the elastomer material between the confronting flanged edges of the plates. The provision of the downwardly extending flange upon each edge 50 of upper plate 16 effects broader distribution of the stresses imposed upon the elastomeric material 20 and upon the bottom plate flange 40 during lateral displacement of upper plate 16. The previously described reinforcement associated with the upstanding flanges 40 integral with bottom plate edges 22 enable such flanges to withstand, without structural failure, the high-magnitude lateral forces imposed thereon during use of assembly 10.

While preferred embodiments of the invention have been specifically shown and described, this was for purposes of illustration only, and not for purposes of limitation, the scope of the invention being in accordance with the following claims.

We claim:

1. In a rail fastener assembly for resiliently mounting a rail upon a support structure, said assembly including a lower plate having a pair of opposite peripheral edges extending generally in the rail direction, said edges having upstanding flanges integral therewith and extending generally vertically upwardly therefrom, a rail supporting upper plate disposed in vertically spaced overlying relationship to said lower plate and having opposite peripheral edge portions in laterally spaced confronting relationship to said flanges of said lower plate, and resilient elastomeric material interconnecting said plates for resilient vertical and lateral movement of said upper plate relative to said lower plate, the improvement comprising: generally horizontally extending flanges formed integrally with and projecting outwardly from said upstanding flanges adjacent the upper ends thereof, said horizontally extending flanges increasing the ability of said upstanding flanges to withstand without failure lateral forces imposed thereon during use of the assembly and said lower plate has a second pair of opposite peripheral edges generally perpendicular to said first mentioned pair; flange means upon at least one of said opposite peripheral edges for further increasing the failure resistance of said upstanding flanges upon said edges of said first pair, and for limiting movement of upper plate in the rail direction.

2. An assembly as in claim 1, wherein said flange means includes upstanding flanges integral with sections of said edges of said second pair and integrally connected to associated ones of said first mentioned upstanding flanges.

3. An assembly as in claim 2, wherein said second mentioned upstanding flanges taper in height along part of the length thereof.

4. An assembly as in claim 3, wherein said flange means further includes, along part of the length thereof, generally horizontally extending flanges formed integrally therewith and integrally connected to associated ones of said first mentioned horizontally extending flanges.

5. An assembly as in claim 1, wherein said flange means terminate intermediate the lengths of said edges of said second pair.

6. An assembly as in claim 1, wherein said edge portions of said upper plate have integral flanges thereon.

7. An assembly as in claim 1, wherein said assembly has fastener receiving enclosures at locations on opposite sides thereof and means defining outlet openings communicating with said enclosures for minimizing debris accumulation therein.

8. An assembly as in claim 1, including means for securing said lower plate in a desired laterally adjusted portion upon said underlying support structure, said securing means including an opening within said lower plate having toothed opposite edges extending generally perpendicular to the rail direction, a washer element receivable within said plate opening and having toothed edges adapted to intermesh with said toothed edges of said plate, the teeth of one of said edges of said washer element and of said plate opening being staggered and offset relative to the teeth of the other of said edges of said washer element and said plate opening, said washer element having a fastener-receiving opening extending therethrough.

9. An assembly as in claim 8, wherein said opening is one of a pair thereof disposed within diagonally opposite corner sections of said lower plate, and wherein said washer element is one of a pair thereof respectively associated with said openings.

10. An assembly as in claim 7, wherein each of said enclosures has a lower surface sloping downwardly toward the one of said outlet openings of said enclosure.

* * * * *